US005791642A

United States Patent [19]

Sawano et al.

[11] Patent Number: 5,791,642

[45] Date of Patent: *Aug. 11, 1998

[54] DISCHARGED SHEET ACCOMMODATING TRAY

[75] Inventors: Mitsuru Sawano; Hironobu Satou, both of Shizuoka, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 754,259

[22] Filed: Nov. 20, 1996

[30] Foreign Application Priority Data

Dec. 8, 1995 [JP] Japan ..... 7-320587

[51] Int. Cl.[6] ..... B65H 39/02

[52] U.S. Cl. ..... 270/58.01; 271/161

[58] Field of Search ..... 270/58.01; 271/161, 271/209

[56] References Cited

U.S. PATENT DOCUMENTS

| | | | |
|---|---|---|---|
| Re. 27,814 | 11/1973 | Hanson | 271/209 |
| 4,466,607 | 8/1984 | Clark et al. | 271/209 |
| 4,469,319 | 9/1984 | Robb et al. | 271/209 |
| 4,696,463 | 9/1987 | Nakazato et al. | 271/209 |
| 4,898,374 | 2/1990 | Vermaat | 271/209 |
| 5,385,340 | 1/1995 | Hiroi et al. | 270/53 |
| 5,388,818 | 2/1995 | Anton et al. | 271/209 |

*Primary Examiner*—John T. Kwon

*Attorney, Agent, or Firm*—Sughrue, Mion, Zinn, Macpeak & Seas, PLLC

[57] ABSTRACT

A discharged sheet accommodating tray in which sheets discharged from a discharging section along surfaces of the sheets are successively stacked, includes: a placement surface on which the sheets discharged from the discharging section are placed; and a sheet ride-on portion provided at the placement surface and which sheets being discharged ride on. The sheet ride-on portion can be a convex portion or an inclined plate located in an intermediate central portion of the placement surface, or can be a plurality of convex portions or inclined plates disposed in an intermediate central portion of the placement surface along a direction orthogonal to the sheet discharging direction. Accordingly, sheets which have already been placed on the placement surface have a mountain-shaped configuration at the sheet ride-on portion. When a leading end portion of a sheet which is being discharged passes over a peak portion of the mountain-shaped configuration, a gap is formed between the leading end portion and a sheet which has already been placed, such that close contact of the sheet which has already been placed and the sheet which is being discharged is prevented.

11 Claims, 4 Drawing Sheets

DISCHARGED SHEET ACCOMMODATING TRAY

BACKGROUND OF THE INVENTION

1. Field of the Invention

The present invention relates to a discharged sheet accommodating tray in which sheets, such as films or printed papers, which have been discharged from a printer, a copier, or the like are stacked.

2. Description of the Related Art

Printing devices such as printers or copiers are equipped with a discharged sheet accommodating tray in which sheets such as printed papers, films or the like are stacked. A sheet for which printing has been completed and which is to be discharged from the printing device is discharged, by being nipped from above and below by conveying rollers, into a discharged sheet accommodating tray which is set beneath the sheet discharging section of the printing device so as to be slightly tilted upwardly with respect to the direction in which the sheets are discharged. The sheets are stacked in the discharged sheet accommodating tray in the order in which they are discharged.

Conventionally, the sheet stacking surface of the discharged sheet accommodating tray (i.e., the placement surface) has generally been formed only as a flat surface. Accordingly, when sheets discharged from the printing device are placed on the placement surface of the discharged sheet accommodating tray, the sheets become flat in conformance with the placement surface. A sheet discharged thereafter is pushed out while contacting the flat upper surface of the uppermost sheet among the sheets which have already been placed, i.e., the discharged sheets, and is placed on the discharged sheets. This process is repeated so as to stack discharged sheets on the discharged sheet accommodating tray.

However, the placement surface of the conventional discharged sheet accommodating tray is flat, and the sheets placed thereon also become flat in conformance with the flat placement surface. Therefore, as illustrated in FIG. 9, a sheet 1 discharged in succession is pushed out while contacting the flat upper surface of an uppermost sheet 3 of the stack of sheets already placed in a discharged sheet accommodating tray 5, and the flat surfaces of the sheet 1 and the sheet 3 slide. Due to the frictional force or electrostatic attractive force at this time, the sheet 1 which is being discharged and the uppermost sheet 3 stick together, and the sheet 1 being discharged either pushes the uppermost sheet 3 out from the discharged sheet accommodating tray 5 (so-called "pushing-falling"), or, as illustrated in FIG. 10, a leading end portion la of the sheet 1 being discharged sticks to the uppermost sheet 3, and the sheet 1 curls because it is discharged in a state of being stuck to the uppermost sheet 3. After the sheet 1 is discharged, it may fall from the discharged sheet accommodating tray 5 due to the elastic restoring force of the sheet 1 (so-called "curling-falling").

When thin plates or sheets formed from resin materials are discharged, a particularly great electrostatic attractive force is generated. As a result, a sheet being discharged may stick to the uppermost sheet of the sheets which have already been discharged, such that discharging becomes impossible and a sheet jam (jam error) occurs.

SUMMARY OF THE INVENTION

In view of the aforementioned, an object of the present invention is to provide a discharged sheet accommodating tray in which the sticking of a sheet being discharged to a sheet already placed on the discharged sheet accommodating tray can be prevented, so as to prevent pushing-falling, curling-falling, and jam errors.

A first aspect of the present invention is a discharged sheet accommodating tray in which sheets discharged from a discharging section generally along surfaces of the sheets are successively stacked, comprising: a placement surface on which the sheets discharged from the discharging section are placed; and a sheet ride-on portion having a peak portion in a sheet discharging direction intermediate portion of the placement surface, and sheets which are being discharged ride on the sheet ride-on portion.

In accordance with the discharged sheet accommodating tray of the first aspect, when, for example, a first sheet discharged from the discharging section is placed on the placement surface, a sheet discharging direction intermediate portion of the first sheet forms a mountain-shaped portion which is bent by the sheet ride-on portion. Then, the leading end portion of a second sheet which is being discharged from the discharging portion rides on the mountain-shaped portion of the first sheet which has already been placed on the placement surface. For a short while, a gap is formed between the sheet which has already been placed and the leading end portion of the second sheet which rides on the mountain-shaped portion, such that the leading end portion does not contact the sheet which has already been placed. Thereafter, due to its own weight, the leading end portion drops down, and the second sheet is fed out with the leading end portion thereof again contacting the already-placed sheet, such that the second sheet is placed on top of the first sheet. In other words, while the second sheet is being discharged, air enters into the gap formed between the first sheet and the second sheet, and the sheets do not contact each other in a state of being fit close together. Further, the sheets from the third sheet on which are discharged successively from the discharging section are respectively discharged with a gap being formed between the leading end portion thereof and the uppermost sheet of the sheets placed on the placement surface, and are placed on the uppermost sheet. In this way, a gap is formed between the sheet being discharged and the uppermost sheet of the sheets already placed on the placement surface, and air enters into the gap. Therefore, the sheet being discharged and the uppermost sheet are not in a state of being fit close together. The contact frictional force and the electrostatic attractive force between the two sheets can be made small, and sticking together of the two sheets can be prevented. As a result, pushing-falling, curling-falling, sheet jams and the like which are caused by the sticking together of sheets can be prevented.

The sheet ride-on portion may be formed, for example, by providing on the placement surface a convex portion which projects upwardly or by providing on the placement surface an inclined plate which is inclined slightly upward with respect to the sheet discharging direction. Further, the sheet ride-on portion may be provided at, for example, a sheet discharging direction substantially central portion of the placement surface, or a plurality of sheet ride-on portions may be provided along the sheet discharging direction. Moreover, a plurality of convex portions or a plurality of inclined plates may be provided along a direction substantially orthogonal to the sheet discharging direction of the placement surface. The sheet ride-on portion may also be formed by forming the entire placement surface in a mountain-shape.

A second aspect of the present invention is a discharged sheet accommodating tray in which sheets discharged from a discharging section generally along surfaces of the sheets are successively stacked, comprising: a placement surface on which the sheets discharged from the discharging section are placed; and a step portion provided at the placement surface and extending in a direction substantially orthogonal to a sheet discharging direction, a portion of the placement surface at a sheet discharging direction downstream side of the step portion being lower than a portion of the placement surface at a sheet discharging direction upstream side of the step portion.

In accordance with the discharged sheet accommodating tray of the second aspect, for example, an inclined portion is formed, via the step portion, in a first sheet already placed on the placement surface. Then, the leading end portion of a second sheet which is being discharged reaches the inclined portion of the first sheet, and, for a short while, the second sheet is conveyed with the leading end portion thereof not contacting the first sheet and with a gap being formed between the first sheet and the second sheet. Thereafter, the second sheet drops down due to its own weight, and is discharged while again contacting the first sheet, so as to be placed on the first sheet. In other words, while the second sheet is being discharged, air enters into the gap formed between the first sheet and the second sheet, such that the sheets do not contact each other in a state in which respective surfaces thereof are fit closely to one another. The discharging of the sheets from the third sheet on is carried out in the same manner as in the previously-described first aspect.

DESCRIPTION OF THE PREFERRED EMBODIMENTS

Figure 1:
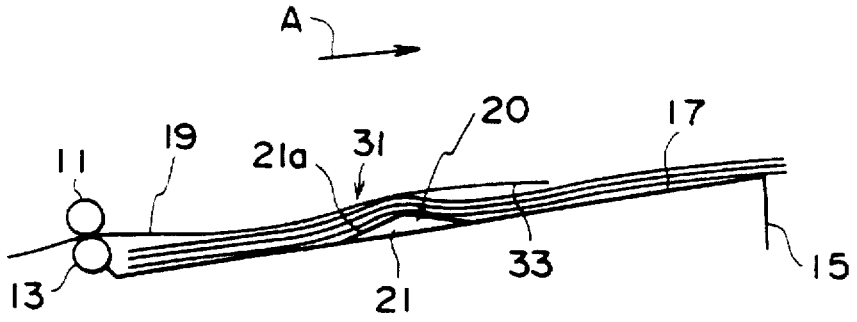
FIG. 1 is a side view illustrating a first embodiment of a discharged sheet accommodating tray in accordance with the present invention.

Hereinafter, preferred embodiments of a discharged sheet accommodating tray relating to the present invention will be described in detail with reference to the figures. FIG. 1 is a side view illustrating a first embodiment of a discharged sheet accommodating tray relating to the present invention.

A discharged sheet accommodating tray 15 is provided at a sheet discharging direction A side of conveying rollers 11, 13 which form a discharging section of a printer or the like. The discharged sheet accommodating tray 15 has a flat placement surface 17. The placement surface 17 is inclined slightly downwardly toward the conveying rollers 11, 13 side. Namely, the discharged sheet accommodating tray 15 is set at the printer such that the placement surface 17 is inclined slightly upwardly along the sheet discharging direction A. After a sheet 19 is discharged by the conveying rollers 11, 13, the sheet 19 is placed on the placement surface 17. Because the placement surface 17 is inclined slightly at the conveying roller 11, 13 side, the inertia, in the sheet discharging direction A, of the sheet 19 placed on the placement surface 17 is canceled.

A convex portion 21, which serves as a sheet ride-on portion 20, is provided at a sheet discharging direction center of the placement surface 17. The convex portion 21 is substantially mountain-shaped, and at least the surface thereof at the conveying rollers 11 side has a smooth inclined surface 21*a* which slopes downward toward the conveying rollers 11. The sheet 19 which is pushed out along the placement surface 17 thereby rides on the convex portion 21. The convex portion 21 may be a solitary protrusion provided at the center in the transverse direction of the discharged sheet accommodating tray 15 (the direction orthogonal to the discharging direction of the sheet 19), or may be two projections, one provided at either transverse direction end of the discharged sheet accommodating tray 15, or may be a long projection extending along the transverse direction of the discharged sheet accommodating tray 15, or the like.

It is preferable that the height of the convex portion is 5 mm to 50 mm. Further, it is preferable that the convex portion 21 is disposed within a range whose center is the sheet discharging direction A center of the placement surface 17 and whose length is about 60% of the entire length of the sheet. The dimensions of the sheet 19 may be, for example, a discharging direction length of about 600 mm and a transverse direction width of around 320 mm. The sheet 19 may be, for example, a multi-layer image-receiving sheet having a cushion layer thickness of 20 μm and an image-receiving layer thickness of 1 μm.

Operation of the discharged sheet accommodating tray 15 structured as described above will be described hereinafter.

The leading end of the sheet 19 which is first discharged from the conveying rollers 11, 13 is pushed along the placement surface 17 and temporarily rides on the convex portion 21. Thereafter, due to it own weight, the sheet 19 bends and is again pushed along the placement surface 17 so as to be placed thereon. Accordingly, the sheet 19 is placed such that a curved mountain-shaped portion 31 is formed in the center of the sheet 19 due to the convex portion 21.

Then, when the second sheet 19 is discharged from the conveying rollers 11, 13, the second sheet 19 is pushed out with the leading end portion thereof contacting the first sheet 19 which has already been placed, and the leading end portion of the second sheet 19 approaches the central portion of the discharged sheet accommodating tray 15. In this state, the length of the second sheet 19 which has been discharged out from the conveying rollers 11, 13 is less than or equal to one half of the entire length of the sheet 19, and no great contact frictional force is generated between the first sheet 19 and the second sheet 19.

When the second sheet 19 approaches the central portion of the discharged sheet accommodating tray 15, the leading end of the second sheet 19 rides on the mountain-shaped portion 31 of the first sheet 19 which has already been placed. Due to the rigidity of the second sheet 19, the leading end of the second sheet 19 which rides on the mountain-shaped portion 31 is, for a short time, conveyed without touching the first sheet 19 with a gap 33 being formed between the first sheet 19 and the leading end of the second sheet 19. The second sheet 19, which is being discharged with the gap 33 between the first sheet 19 and the second sheet 19, thereafter drops down due to its own weight and is pushed out while again contacting the first sheet 19.

At this time, air enters in the gap 33 formed between the first sheet 19 and the second sheet 19 so that respective surfaces of the sheets 19 do not contact each other in a state of fitting closely to one another. In this way, the second sheet 19 which has passed over the mountain-shaped portion 31 is pushed out while contacting the first sheet 19 with little contact friction. Further, because the respective surfaces of the sheets 19 do not contact one another in a state in which they fit closely together, it is difficult for electrostatic attraction to be generated.

Due to the trailing end of the second sheet 19 being fed out from the conveying rollers 11, 13, discharging of the second sheet 19 is completed, and the second sheet 19 is placed so as to be superposed on the top surface of the already-placed first sheet 19. Sheets 19 from the third sheet on are placed in the same manner such that a plurality of the sheets 19 are stacked on the discharged sheet accommodating tray 15.

In accordance with the discharged sheet accommodating tray 15 of the present first embodiment, because the convex portion 21 is provided at the center of the placement surface 17, the mountain-shaped portion 31 is formed in the one or more sheets 19 which have already been placed. Due to a sheet 19 which is being discharged thereafter riding on the mountain-shaped portion 31, the gap 33 is formed between the sheet 19 being discharged and the uppermost sheet of the sheets 19 which have already been placed. Due to air entering into the gap 33, the sheet 19 being discharged and the uppermost sheet 19 do not contact one another in a state of fitting closely together, and therefore, the contact frictional force and the electrostatic attractive force between the sheets 19 can be made small. Thus, the sheets 19 can be prevented from sticking to one another. As a result, pushing-falling of the uppermost sheet 19 from the discharged sheet accommodating tray 15, curling-falling from the discharged sheet accommodating tray 15 of a sheet 19 being discharged, sheet jams and the like, which are caused by sheets sticking together, can reliably be prevented.

Figure 2:
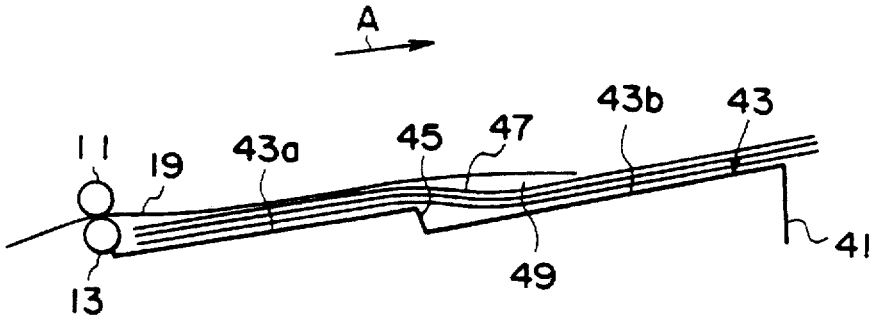
FIG. 2 is a side view illustrating a second embodiment of a discharged sheet accommodating tray in accordance with the present invention.

A second embodiment of the discharged sheet accommodating tray according to the present invention will be described hereinafter. FIG. 2 is a side view illustrating the second embodiment of the discharged sheet accommodating tray of the present invention.

A discharged sheet accommodating tray 41 is provided at a discharging direction A side of the conveying rollers 11, 13. A placement surface 43 is formed at the discharged sheet accommodating tray 41. A step portion 45 is provided at the placement surface 43 substantially centrally in the discharging direction A. The step portion 45 is a border between a front placement surface **43*a* and a rear placement surface 43*b*. The front placement surface 43*a* is disposed higher than the rear placement surface 43*b***.

It is preferable that the height of the step portion 45 is about 5 to 50 mm. Further, it is preferable that the step portion 45 is disposed within a range whose center is the sheet discharging direction A center of the placement surface 17 and whose length is about 60% of the entire length of the sheet.

Operation of the discharged sheet accommodating tray 41 will be described hereinafter.

First, the leading end of the sheet 19 which is first discharged from the conveying rollers 11, 13 is pushed along the front placement surface **43*a* so as to reach the step portion 45. Thereafter, the leading end separates from the placement surface 43 and is conveyed horizontally. Thereafter, the leading end bends downward due to its own weight, and is pushed along the rear placement surface 43*b* and placed on the placement surface 43. Accordingly, the sheet 19 is placed on the placement surface 43 in a state in which the center of the sheet 19 forms an inclined portion 47 which curves due to the step portion 45**.

Next, when the second sheet 19 is discharged from the conveying rollers 11, 13, the leading end portion of the second sheet 19 is pushed out while contacting the sheet 19 which has already been placed (the first sheet), and approaches the central portion of the discharged sheet accommodating tray 41. When the second sheet 19 approaches the central portion of the discharged sheet accommodating tray 41, the leading end of the sheet 19 reaches the inclined portion 47 of the first sheet 19. The leading end of the second sheet 19, which leading end has reached the inclined portion 47, is, for a short while and due to the rigidity of the sheet 19, conveyed without contacting the first sheet 19 and with a gap 49 between the first sheet 19 and the leading end of the second sheet 19. The second sheet 19, which is being discharged with the gap 49 between the first sheet 19 and the second sheet 19, drops downward due to its own weight, and is pushed out while again contacting the first sheet 19.

At this time, air enters into the gap 49 formed between the already-placed first sheet 19 and the second sheet 19, and the sheets 19 do not contact each other in a state in which respective surfaces thereof fit closely together. In this way, the second sheet 19 which has passed the inclined portion 47 is pushed out while contacting the first sheet 19 with little contact friction. Further, because the sheets 19 do not contact each other with respective surfaces thereof fit closely to one another, it is difficult for electrostatic attractive force to be generated.

Due to the trailing end of the second sheet 19 which is discharged in this way being sent out from the conveying rollers 11, 13, discharging is completed, and the second sheet 19 is placed on the discharged sheet accommodating tray 41 in a state of being superposed on the top surface of the sheet 19 which has already been placed. Sheets 19 from the third sheet on are placed on the discharged sheet accommodating tray 41 in the same manner, such that a plurality of the sheets 19 are stacked in the discharged sheet accommodating tray 41.

In accordance with the discharged sheet accommodating tray 41 relating to the second embodiment, the step portion 45 is provided at the center of the placement surface 43. Therefore, the inclined portion 47 is formed in the one or more sheets 19 which have already been placed. Due to a sheet 19, which is discharged thereafter, passing the inclined portion 47, the gap 49 is formed between the sheet 19 which is being discharged and the uppermost sheet 19 of the sheets 19 which have already been placed. Air enters into the gap 49 such that the uppermost sheet 19 and the sheet 19 which is being discharged do not contact each other in a state of being fit closely together. In this way, contact frictional force and electrostatic attractive force between the two sheets 19 can be made small, and the sheets 19 can be prevented from sticking together. As a result, in the same way as in the first embodiment, pushing-falling, curling-falling, paper jams and the like which are caused by sheets sticking together can reliably be prevented.

In accordance with the discharged sheet accommodating tray 41 of the second embodiment, the step portion 45 is provided at the placement surface 43 such that the gap 49 is formed between the sheet 19 which is being discharged and the uppermost sheet 19 of the sheets 19 which have already been placed in the discharged sheet accommodating tray 41. Therefore, unlike the first embodiment, there is no need for the leading end of the sheet 19 being discharged to ride on the convex portion 21, and the discharge resistance of the sheet 19 can be made small.

In the first embodiment, in a case in which the convex portions 21 are provided only at the both transverse direction ends of the placement surface 17 in view of the printer, the side portions of the sheet 19 ride on the respective convex portions 21. The transverse direction central portion of the sheet 19 may sag down concavely (i.e., form a substantially trough-like configuration) along the entire length of the sheet 19 such that the sheet 19 may become rigid and it may be difficult for the mountain-shaped portion 31 to form in the sheet 19.

Figure 3:
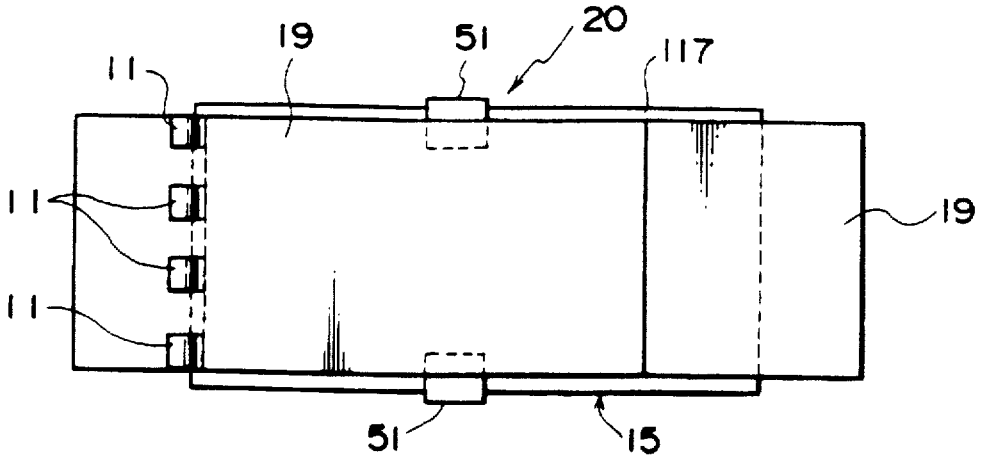
FIG. 3 is a plan view illustrating, as a modified example of the first embodiment, a discharged sheet accommodating tray in which a sheet ride-on portion is provided at either end of a placement surface.
Figure 4:
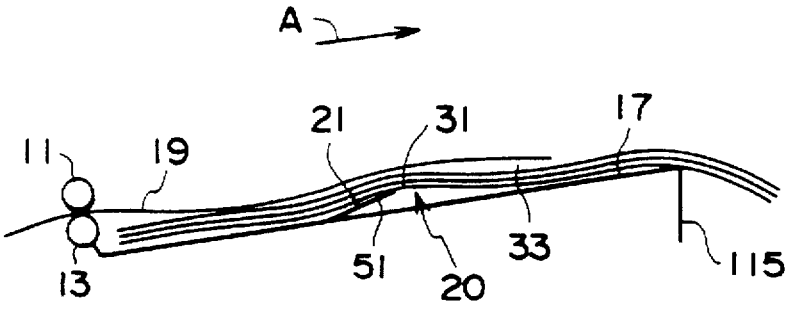
FIG. 4 is a side view of FIG. 3.

In this case, the modified example of the first embodiment illustrated in FIGS. 3 and 4 may be employed. In this modified example, the entire length of a placement surface 117 of a discharged sheet accommodating tray 115 is formed shorter than the entire length of the sheet 19 which is to be placed thereon. If the sheets 19 are placed on the placement surface 117 such that the discharge direction leading end portions thereof hang downward, the sheets 19 will not form a substantially trough-like configuration, the mountain-shaped portion 31 can be formed, and the above-described effects of the gap 33 can be obtained.

In this modified example, as illustrated in FIG. 4, in place of the convex portion 21 of the first embodiment, the sheet ride-on portion 20 is formed only by an inclined plate 51 having an inclined surface which slopes downwardly toward the conveying rollers 11. The inclined plates 51 may be provided by cutting portions of the placement surface 117 and bending the cut portions upwardly, or may be formed by joining substantially rectangular plate-shaped portions to the placement surface 117.

Figure 5:
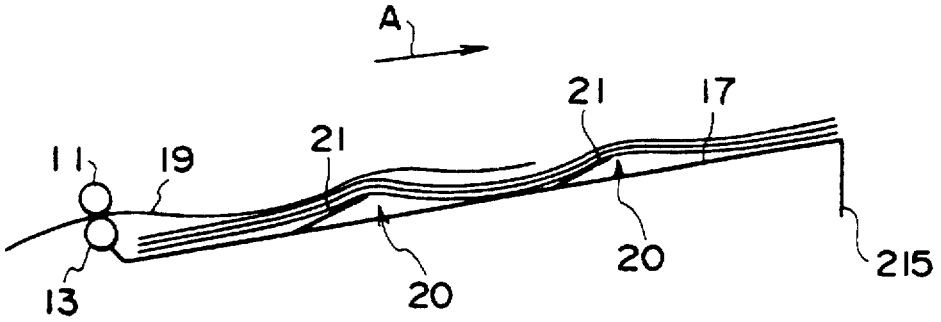
FIG. 5 is a side view illustrating another modified example of the first embodiment.
Figure 6:
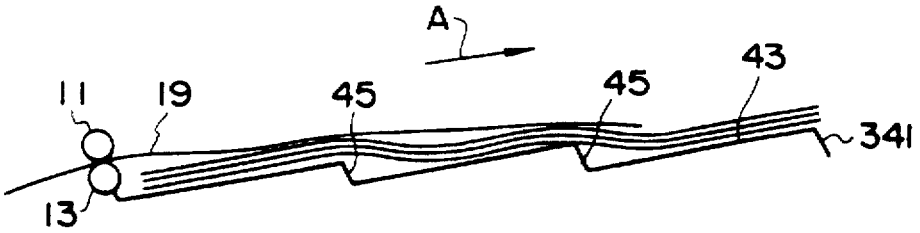
FIG. 6 is a side view illustrating a modified example of the second embodiment.

FIGS. 5 and 6 illustrate other modified examples in which a plurality of sheet ride-on portions and step portions, respectively, are provided along the sheet discharging direction A. As illustrated in FIG. 5, a discharged sheet accommodating tray 215 is provided with inclined plates 51 forming two sheet ride-on portions 20 along the sheet discharging direction A. Further, as illustrated in FIG. 6, a discharged sheet accommodating tray 341 is provided with two step portions 45 along the sheet discharging direction A. In accordance with these structures, the above-described effects can be obtained at a plurality of places of the sheet 19. However, when these structures are used, in accordance with the length of the sheet 19, a number of sheet ride-on portions 20 or step portions 45 must be provided which allows the mountain-shaped portions 31 or the inclined portions 47 to be maintained. Further, in the modified example of FIG. 5, the sheet ride-on portions 20 are formed by the inclined plates 51. However, the convex portions 21 may be formed in place of the inclined plates 51.

Figure 7:
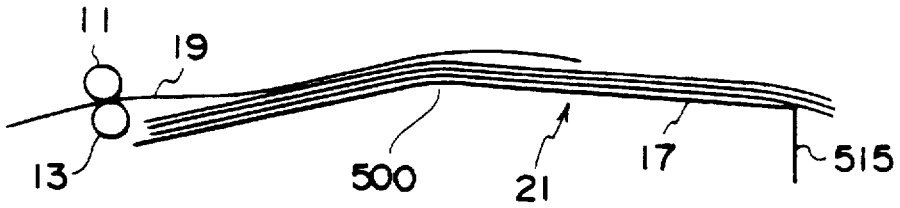
FIG. 7 is a side view illustrating yet another modified example of the first embodiment.
Figure 8:
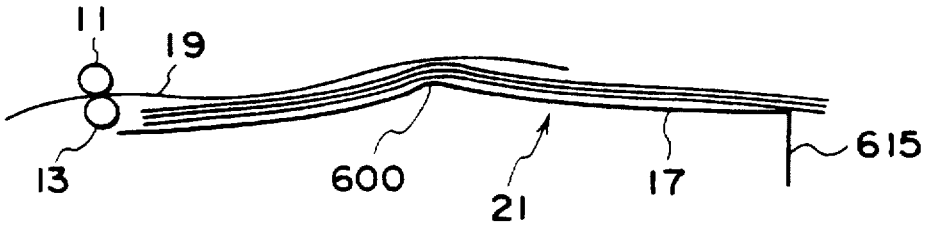
FIG. 8 is a side view illustrating still another modified example of the first embodiment.
Figure 9:
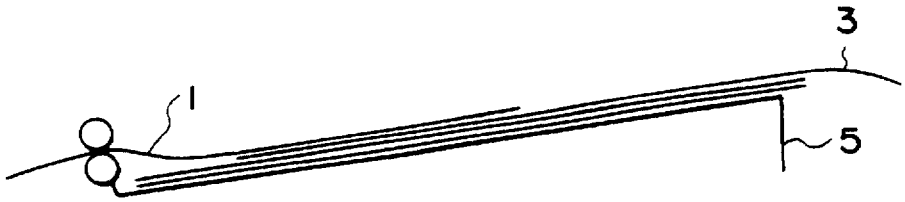
FIG. 9 PRIOR ART
FIG. 9 is a side view for explaining pushing-falling in a conventional discharged sheet accommodating tray.
Figure 10:
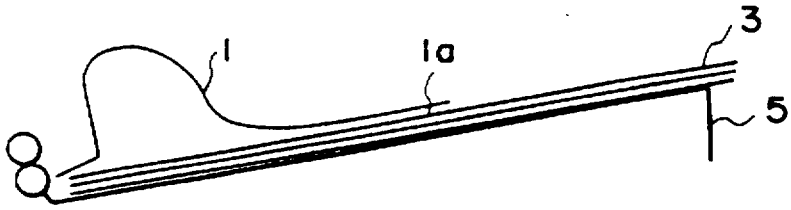
FIG. 10 PRIOR ART
FIG. 10 is a side view for explaining curling-falling in a conventional discharged sheet accommodating tray.

The discharged sheet accommodating tray may be formed such that the entire placement surface thereof forms a sheet ride-on portion. For example, as illustrated by the modified example of FIG. 7, the placement surface 17 of a discharged sheet accommodating tray 515 has a peak portion 500 at the sheet discharging direction substantially central portion thereof. The surfaces at the respective sides of the peak portion 500 along the sheet discharging direction are inclined surfaces which are inclined slightly downward. Namely, the placement surface 17 forms, on the whole, the convex portion 21. Further, in the modified example illustrated in FIG. 8, in the same way as the modified example of FIG. 7, the placement surface 17 of a discharged sheet accommodating tray 615 has a peak portion 600 at the sheet discharging direction substantially central portion thereof. However, in the modified example of FIG. 8, the surfaces at either side of the peak portion 600 along the sheet discharging direction form inclined surfaces which are curved slightly downward and inclined slightly downward. In this modified example as well, the placement surface 17 forms, on the whole, the convex portion 21.

Hereinafter, an example of a sheet which is applicable to the discharged sheet accommodating tray of the present invention will be described.

In the image-receiving material disclosed in Japanese Patent Application Laid-Open (JP-A) No. 7-132678, a cushion layer having the following composition and a thickness of 20 μm is applied onto a 100 μm thick substrate formed from Crisper G2323 white PET manufactured by Toyobo Co., Ltd. Then, a 1 μm thick image-receiving layer of the following composition is applied onto the cushion layer.

| Cushion Layer | |
|---|---|
| polymer ethylene-ethylacrylate copolymer (manufactured by Mitsui Petrochemical Industries, Ltd.; Everflex A-709) | 20 parts by weight |
| fluorine-containing surface active agent (manufactured by Dainippon Ink and Chemicals, Incorporated; Megafac F177P) | 0.1 parts by weight |
| solvent | 100 parts by weight |
| **Image-Receiving Layer** | |
| nylon | 2 parts by weight |
| butyral | 9 parts by weight |
| fluorine-containing surface active agent 10% propyl alcohol | 1.5 parts by weight |
| n-propyl alcohol | 58 parts by weight |
| MFG-acetate | 14 parts by weight |

What is claimed is:

1. A discharged sheet accommodating tray in which sheets discharged from a discharging section generally along surfaces of the sheets are successively stacked one sheet at a time, comprising:

a placement surface on which the sheets discharged from the discharging section are placed; and a sheet ride-on portion having a peak portion in a sheet discharging direction intermediate portion of said placement surface, wherein sheets which are being discharged ride on said sheet ride-on portion, and are urged against said sheet ride-on portion only by the weight of each of said sheets, and wherein a portion of said placement surface downstream of said peak portion is lower than said peak portion to provide separation between a sheet being discharged and sheets previously discharged.

2. A discharged sheet accommodating tray according to claim 1, wherein said sheet ride-on portion is provided in a sheet discharging direction substantially central portion of said placement surface.

3. A discharged sheet accommodating tray according to claim 2, wherein said sheet ride-on portion is a convex portion.

4. A discharged sheet accommodating tray according to claim 3, wherein a plurality of said convex portions are provided along a direction substantially orthogonal to the sheet discharging direction of said placement surface.

5. A discharged sheet accommodating tray according to claim 2, wherein said sheet ride-on portion is formed by an inclined plate which is inclined upwardly with respect to the sheet discharging direction.

6. A discharged sheet accommodating tray according to claim 5, wherein a plurality of said inclined plates are provided along a direction substantially orthogonal to the sheet discharging direction of said placement surface.

7. A discharged sheet accommodating tray according to claim 1, wherein a plurality of said sheet ride-on portions are provided along the sheet discharging direction of said placement surface.

8. A discharged sheet accommodating tray according to claim 7, wherein said sheet ride-on portions are formed by convex portions.

9. A discharged sheet accommodating tray according to claim 7, wherein said sheet ride-on portions are inclined plates which are inclined upwardly with respect to the sheet discharging direction.

10. A discharged sheet accommodating tray according to claim 1, wherein said sheet ride-on portion comprises said entire placement surface in an upwardly-directed convex shape.

11. A discharged sheet accommodating tray according to claim 10, wherein said convex shape is substantially mountain-shaped.

* * * * *